US006865874B2

(12) United States Patent
Straaten

(10) Patent No.: US 6,865,874 B2
(45) Date of Patent: Mar. 15, 2005

(54) METHOD AND DEVICE FOR RESTARTING THE SPINNING OF OPEN-END SPINNING DEVICES

(75) Inventor: Paul Straaten, Schwalmtal (DE)

(73) Assignee: W. Schlafhorst AG & Co., Moenchengladbach (DE)

( * ) Notice: Subject to any disclaimer, the term of this patent is extended or adjusted under 35 U.S.C. 154(b) by 220 days.

(21) Appl. No.: 10/215,887

(22) Filed: Aug. 9, 2002

(65) Prior Publication Data

US 2003/0029154 A1 Feb. 13, 2003

(30) Foreign Application Priority Data

Aug. 9, 2001 (DE) ..... 101 39 078

(51) Int. Cl.[7] ..... B65H 69/06
(52) U.S. Cl. ..... 57/22; 57/263
(58) Field of Search ..... 57/22, 23, 261, 57/263, 279, 280; 242/473–474.2, 475.1–476.6

(56) References Cited

U.S. PATENT DOCUMENTS

| | | | | |
|---|---|---|---|---|
| 4,041,684 A | | 8/1977 | Kamp | 57/34 R |
| 4,501,116 A | * | 2/1985 | Schuller et al. | 57/263 |
| 5,022,222 A | * | 6/1991 | Rupert et al. | 57/263 |
| 5,083,420 A | | 1/1992 | Rupert et al. | 57/263 |
| 5,337,550 A | * | 8/1994 | Mayer et al. | 57/263 |
| 5,473,879 A | | 12/1995 | Gobbels et al. | 57/263 |
| 5,634,602 A | | 6/1997 | Gobbels et al. | 242/18 |
| 5,681,000 A | * | 10/1997 | Gobbels et al. | 242/475.7 |
| 6,079,195 A | * | 6/2000 | Stahlecker | 57/263 |
| 6,272,832 B1 | * | 8/2001 | Gobbels et al. | 57/263 |

FOREIGN PATENT DOCUMENTS

| | | |
|---|---|---|
| DE | 2 203 198 | 8/1973 |
| DE | 25 41 589 | 3/1977 |
| DE | 43 13 523 A1 | 10/1994 |
| DE | 44 43 818 A1 | 6/1996 |
| JP | 06220728 | 9/1994 |

OTHER PUBLICATIONS

German Search Report.
European Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A method and device for restarting a spinning operation at work stations (2) of an open-end spinning machine (1) after replacement of a cheese (8) with an empty tube by a traveling service unit (16) comprising an auxiliary yarn supply device (21). Each work station comprises a yarn spinning device (3) and a cheese winding device (4) with a creel (9). The auxiliary yarn supply device (21) delivers a starting portion of an auxiliary yarn (24) to a suction nozzle (14), which transfers the auxiliary yarn (24) to a spinning start member (20), after which the suction nozzle (14) pivots to re-take the auxiliary yarn (24) between the supply device (21) and the spinning start member (20) and removes the auxiliary yarn (24) after restarting the spinning operation, whereupon the yarn (7) is brought to the creel (9) of the work station (2).

14 Claims, 12 Drawing Sheets

METHOD AND DEVICE FOR RESTARTING THE SPINNING OF OPEN-END SPINNING DEVICES

CROSS-REFERENCES TO RELATED APPLICATIONS

This application claims the benefit of German patent application 10139078.5, filed Aug. 9, 2001, herein incorporated by reference.

BACKGROUND OF THE INVENTION

The present invention relates generally to a method and a device for restarting a spinning operation in work stations of an open-end spinning machine after replacement of a cheese with an empty cheese tube, and relates more particularly to such a method and device wherein the work stations each comprise a spinning device for producing a yarn and a winding device with a creel for winding the yarn into a cheese and wherein an automatically operating service unit comprising an auxiliary yarn supply device attends the plural work stations.

As is known, open-end spinning machines have a plurality of adjacent work stations, each of which comprises a spinning device for manufacturing a yarn and comprises a winding device with a creel and a yarn traversing device for producing a cross-wound bobbin commonly referred to as a cheese.

The work stations of such open-end spinning machines are typically served by automatically operating service units that intervene if a need for service has occurred at one of the work stations. Such a need for service occurs, e.g., in case of a yarn break or if the cheese at one of the work stations has attained its prescribed diameter and must be replaced by a new empty tube.

That is, such service units described, e.g., in German Patent Publication DE 44 43 818 A1 or in DE 43 13 523 A1 not only eliminate yarn breaks but also automatically carry out cheese/empty tube replacements. For example, in the case of a cheese/empty tube replacement, the full cheese is removed from the creel of the particular work station and transferred onto a transport device of the machine. Then, a new, empty tube is placed into the creel, the open-end spinning device started to spin again by means of a so-called auxiliary yarn and the new spinning yarn is fixed on the freshly replaced empty tube.

The known service units comprise numerous manipulation devices, e.g., a pivotably supported, vacuum-loadable suction nozzle for grasping a trailing yarn wound onto the cheese in the case of a yarn break, and a supply device with a pivotably supported supply tube for making available an auxiliary yarn required after a cheese/empty tube replacement for a spinning restart. Moreover, these service units comprise a yarn placement device for fixing the new spinning yarn on the empty tube and for creating a yarn reserve winding.

The described service units have proven themselves in practice and have been used for years with success. However, such service units have the disadvantage that they require a vacuum, e.g., for operating their suction nozzle and to remove by suction and dispose of any auxiliary yarn or the spinning start yarn portion.

The known open-end spinning machines are provided for this reason with so-called suction traverses in addition to their regular vacuum system, that makes the spinning vacuum necessary for the spinning process available. The suction traverses, that extend along the work stations, are arranged in the area of the upper part of the spinning machine and comprise a rotary slider valve at each work station to which valve the service unit docks with a trunk-like device if service is required.

SUMMARY OF THE INVENTION

In view of the previously cited state of the art, it is an object of the present invention to provide a method and a device for enabling an orderly operation of the work stations, especially for servicing the work stations by means of a service unit without the expensive necessity of supplying the service traveler with a vacuum.

The invention addresses this objective by providing a method, and a device for carrying out the method, which basically provide for restarting a spinning operation in work stations of an open-end spinning machine after replacement of a completed yarn cheese with an empty cheese-winding tube, wherein the spinning machine comprises multiple work stations, each work station having a spinning device for producing a yarn and a winding device with a creel for winding the yarn into a cheese, and an automatically operating service unit comprising an auxiliary yarn supply device for attending the plural work stations. According to the present invention, the method basically comprises transferring a starting portion of an auxiliary yarn from the auxiliary yarn supply device of the service unit to a suction nozzle of a work station requiring restarting of the spinning operation, transferring the auxiliary yarn via the suction nozzle to a spinning start member of the work station, moving the suction nozzle again to the auxiliary yarn, re-grasping via the suction nozzle the auxiliary yarn extending between the auxiliary yarn supply device and the spinning start member, removing via the suction nozzle the auxiliary yarn after the auxiliary yarn has been used in the spinning device of the work station for restarting the spinning operation, and moving the yarn produced in the spinning device to the creel of the work station to resume winding thereof.

The method of the present invention has the particular advantage that a vacuum is not required either during the elimination of a yarn break or during a cheese/empty tube replacement process by the service unit. That is, the vacuum required in these instances is available via the suction nozzle forming part of the work station, which nozzle is connected directly to the vacuum system of the open-end spinning machine. Thus, in the case of a simple yarn break the use of the service unit is no longer required since the work stations are to a very great degree self-sufficient on account of the suction nozzle forming part of the work station and on account of the spinning start member forming part of the work station.

The service unit only makes available the auxiliary yarn required after a cheese/empty tube replacement for restarting the spinning operation and shifts newly joined yarns into the range of the creel by means of the auxiliary yarn.

The actual transport of the auxiliary yarn to the appropriate functional elements of the work station as well as the removal of the auxiliary yarn after a successful spinning restart take place by means of the suction nozzle forming part of the work station.

An advantageous sequence provides for the mouth of the supply tube of the auxiliary yarn supply device of the service unit to be positioned in its various operating positions. A twofold, reliable transfer of the auxiliary yarn to the suction nozzle forming part of the work station is assured in the described sequences and therewith the prerequisite created for a properly functioning transfer of the auxiliary yarn to the spinning start member forming part of the work station as well as for a reliable removal of the auxiliary yarn at the end of the spinning start process.

An advantageous embodiment of the method of the present invention provides for the new spinning yarn moved into the range of the creel to be fixed in a defined manner on an empty tube rotatably supported in the creel. That is, the new spinning yarn is clamped, e.g., between one of the tube plates of the creel and between the adjacent front side of the empty tube.

An alternative method provides for arranging the supply tube stationarily and for providing an additional apparatus that is pivoted into the auxiliary yarn extending between the supply tube and the spinning start member, thereby forming a yarn loop. The yarn loop can be used subsequently in a simple manner for moving the auxiliary yarn into the range of the winding device.

Moreover, a further advantageous embodiment provides for the auxiliary yarn made available by the supply device to be separated before its final transfer to the suction nozzle forming part of the work station by a yarn cutting device arranged inside the auxiliary yarn supply device. Since the suction nozzle is positioned at this point in time directly in front of the mouth of the supply tube, a reliable separation of the auxiliary yarn is not only assured but also its reliable transfer into the suction nozzle is assured.

The auxiliary yarn taken over by the suction nozzle is at first transferred to a spinning start member forming part of the work station, prepared therein for the spinning start process that takes place somewhat later and is held available. That is, the starting end portion of the auxiliary yarn is freed at least partially of its spinning rotation in the spinning start member.

The method is also adapted to assure that only an unobjectionable yarn is wound onto the empty tube. That is, it is assured prior to fixing of the new spinning yarn on the empty tube that the auxiliary yarn as well as the spinning start yarn portion have passed through and been removed by suction.

In order to carry out the above-described method steps, the service unit comprises a supply tube that is arranged in such a manner that a suction nozzle forming part of the work station can successively take up the start of the auxiliary yarn and transfer it to a spinning start member forming part of the work station as well as also grasp the auxiliary yarn extending between the supply tube and the spinning start member again and can remove it after the spinning restart.

In addition, a yarn moving device is present in the service unit, which moving device transfers the newly joined yarn into the creel area and fastens it there to the empty tube.

This so-called yarn moving device preferably assures that the yarn is reliably clamped between the adjacent front side of an empty tube and between one of the tube plates of the creel.

According to another aspect of the invention, the supply tube can be loaded in a defined manner by an appropriate drive in such a manner that the mouth of the supply tube can be positioned in various operating positions. That is, the supply tube can be positioned at first by the drive in a first operating position in which the mouth of the supply tube is in the area of the suction intake opening of the suction nozzle loaded with suction air and forming part of the work station. Such a positioning assures a reliable transfer of the auxiliary yarn supplied via the supply tube to the suction nozzle since the start of the auxiliary yarn is drawn in immediately by suction into the suction nozzle and is pneumatically fixed by the latter. The supply tube is then transferred by the drive into a second operating position in which the auxiliary yarn can be moved, e.g., by a yarn moving device, into the area of the creel. The supply tube is subsequently transferred by the drive back into the first operating position, in which the suction nozzle, which has become free in the interim, then takes up the auxiliary yarn again.

In an advantageous embodiment the mouth of the supply tube can be moved by the drive, e.g., a stepping motor, in a circular arc through 360°.

However, it is also possible in an alternative embodiment to provide a linear movement of the supply tube instead of a pivoting drive. In this instance, a drive arrangement is provided that moves the supply tube in a straight line between a first and a second operating position.

A stepping motor is preferably provided as the drive for both types of movement. An exact positioning of the mouth of the supply tube in each desired position is possible in a simple manner with such a stepping motor without great additional expense for control being necessary. Moreover, the use of a stepping motor that is readily available commercially has the advantage that such large-scale series components are relatively economical and matured.

If the supply tube is stationarily arranged, it is advantageous to additionally provide a device designed as a loop puller. Such a loop puller reaches into the auxiliary yarn extending between the supply tube and the spinning start member forming part of the work station and makes it available, e.g., for the yarn moving device, in such a manner that the latter can readily transfer the auxiliary yarn to the creel of the winding device.

Further details, features and advantages of the present invention will be described and understood from the following disclosure of an exemplary embodiment with reference to the accompanying drawings.

DESCRIPTION OF THE PREFERRED EMBODIMENT

Figure 1:
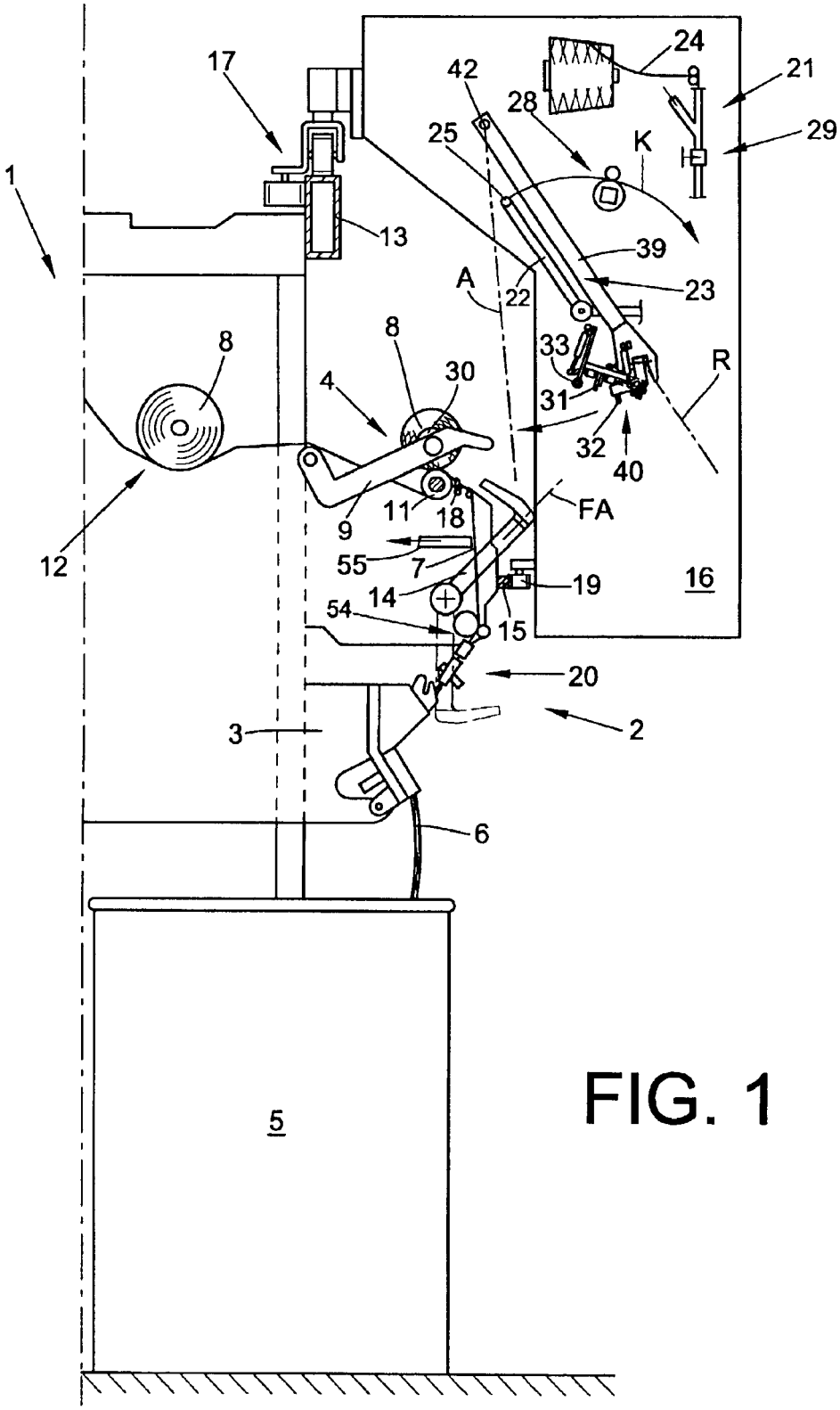
FIG. 1 is a schematic elevational view of one half of an open-end spinning machine equipped with a service unit for carrying out the method of the present invention.

One half of a known open-end spinning machine is indicated in FIG. 1 and identified as a whole at 1. Such spinning machines comprise a plurality of work stations 2, each of which is provided with a spinning device 3 and a winding device 4.

In spinning devices 3, a sliver 6 contained in spinning cans 5 is spun to yarns 7 that are wound on winding devices 4 to cheeses 8. As indicated, winding devices 4 are each equipped with a creel 9 for rotatably holding an empty cheese-winding tube 10 or a yarn-wound cheese 8 and with a winding drum 11 for driving the cheese.

Moreover, work stations 2 each comprise a yarn traversing device 18, a suction nozzle 14 forming part of the work station and further comprise a spinning start member 20 forming part of the work station. That is, work stations 2 are equipped in such a manner that they can automatically eliminate yarn breaks.

In addition, open-end spinning machine 1 comprises bobbin transport device 12 for removing cheeses 8 completed on winding devices 4.

Service unit 16 is movably arranged next to or on spinning machine 1 on guide rail 13 and support rail 15. The travel mechanism of this service unit 16 is comprised of running rollers 17 and support wheel 19. The service unit is supplied with electrical energy preferably via a sliding contact device or via a drag chain. Such service units 16 travel constantly along open-end spinning machine 1 and intervene automatically when a full cheese must be replaced at one of work stations 2 by a new, empty tube and a new spinning start must be made.

To this end, service unit 16 comprises, as is known, numerous manipulation devices that make an orderly cheese/empty tube replacement possible. Of these numerous manipulation devices, only the so-called yarn supply tube 22 with its connected auxiliary yarn supply device 21 and yarn moving device 23 are shown for the sake of better clarity.

Figure 5:
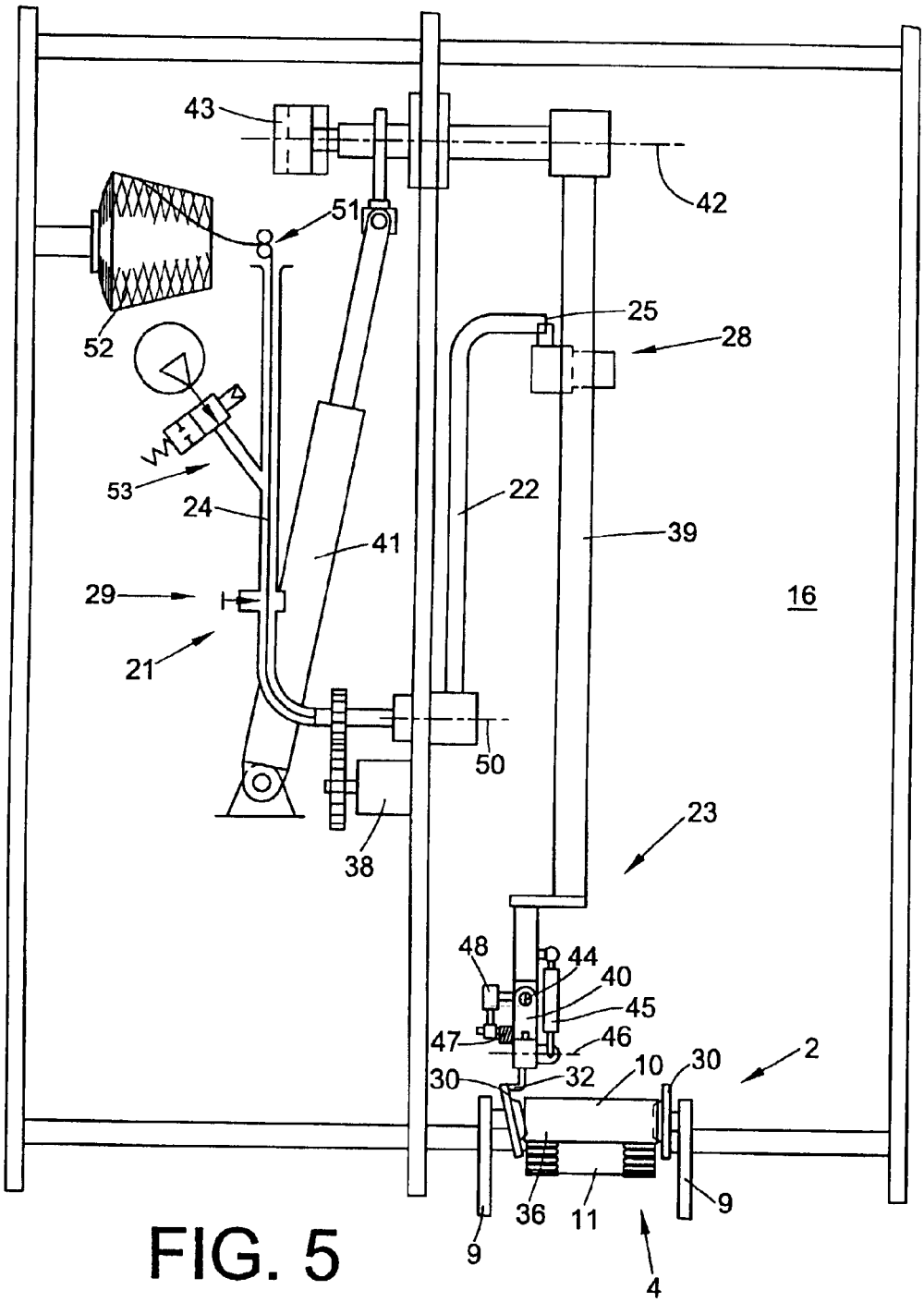
FIG. 5 is an elevational view in partial section of the service unit according to FIG. 2*e* viewed in the direction of arrow X.
Figure 6:
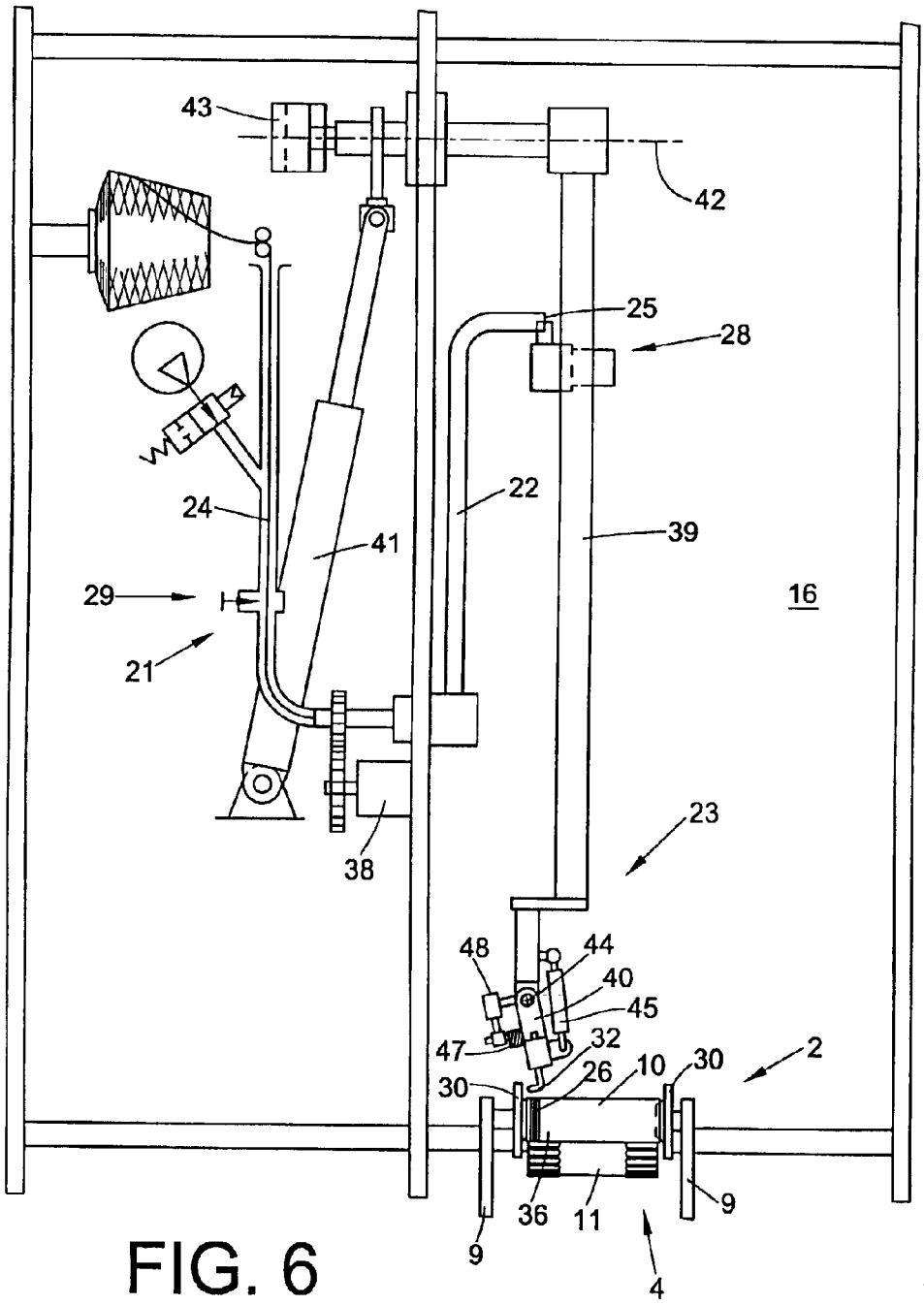
FIG. 6 is an elevational view of the service unit according to FIG. 5 at a somewhat later point in time of the method.

As is indicated in FIGS. 5 and 6 using a rotatably supported supply tube 22, supply tube 22 is rotatably supported, e.g., about pivot axis 50, in an intermediate wall of service unit 16 and can be controlled in a defined manner by stepping motor 38. In this instance, auxiliary yarn supply device 21, that makes auxiliary yarn 24 available, is connected to supply tube 22 via a rotary transmission. Auxiliary yarn supply device 21 basically operates mechanically as well as pneumatically. That is, mechanical supply mechanism 51 is arranged in the area of storage bobbin 52 and draws auxiliary yarn 24 off of supply bobbin 52. The feed of auxiliary yarn 24 preferably takes place pneumatically inside the tube system and/or hose system of auxiliary yarn supply device 21. To this end, auxiliary yarn supply device 21 comprises injector nozzle 53.

Moreover, yarn cutting device 29 is installed in the area of the tube system of auxiliary yarn supply device 21 and cuts auxiliary yarn 24 after its final transfer to suction nozzle 14.

Instead of the rotatable support of supply tube 22 shown in FIGS. 2*a* –2*e,* 5 and 6, a linearly moveable support of the supply tube or a stationary arrangement of supply tube 22 is also possible.

Figure 3:
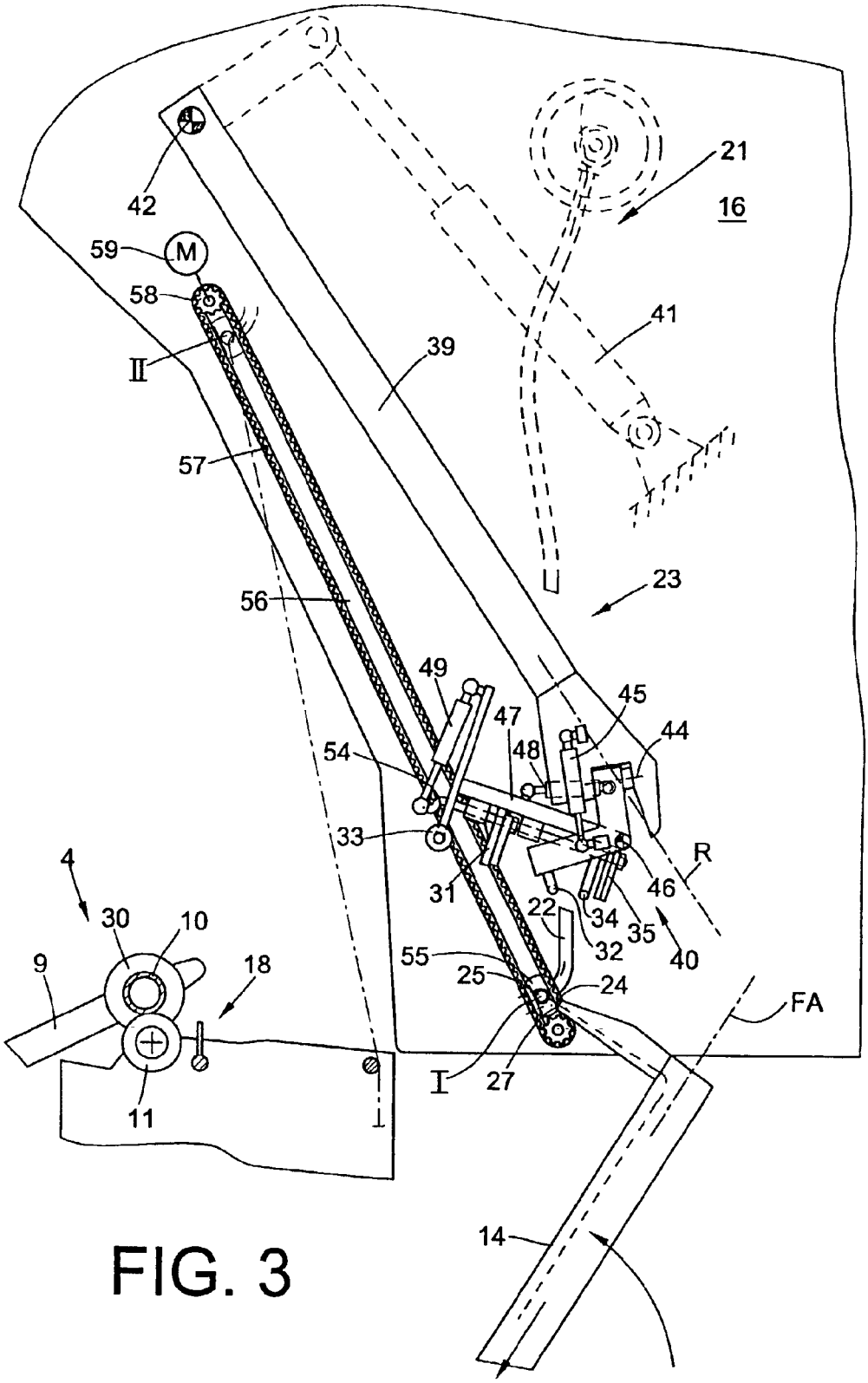
FIG. 3 is another schematic elevational view of the service unit and the winding device similar to FIGS. 2*a*–2*e* with a supply tube supported in a linearly movable manner.

FIG. 3 shows by way of example an auxiliary yarn supply device 21 with supply tube 22 supported in a linearly movable manner. Mouth 25 of the supply tube is fixed, e.g., in sliding carriage 55 that can be moved along linear guidance 56 by a belt drive. The belt drive is comprised of toothed belt 57 fastened to carriage 55 and of two deflection gears 58 arranged one on each end side of guidance 56. One of deflection gears 58 is connected to drive 59 that can be controlled in a defined manner. The construction described above makes it possible to position mouth 25 of supply tube 22 in a defined manner either in operating position I in which suction nozzle 14 of the work station can take auxiliary yarn 24 from supply tube 22, or to shift mouth 25 into operating position II. In operating position II, auxiliary yarn 24 extending between spinning start member 20 of the work station and between mouth 25 of supply tube 22 can be grasped by yarn moving device 23 and moved into the area of winding device 4.

Figure 4A:
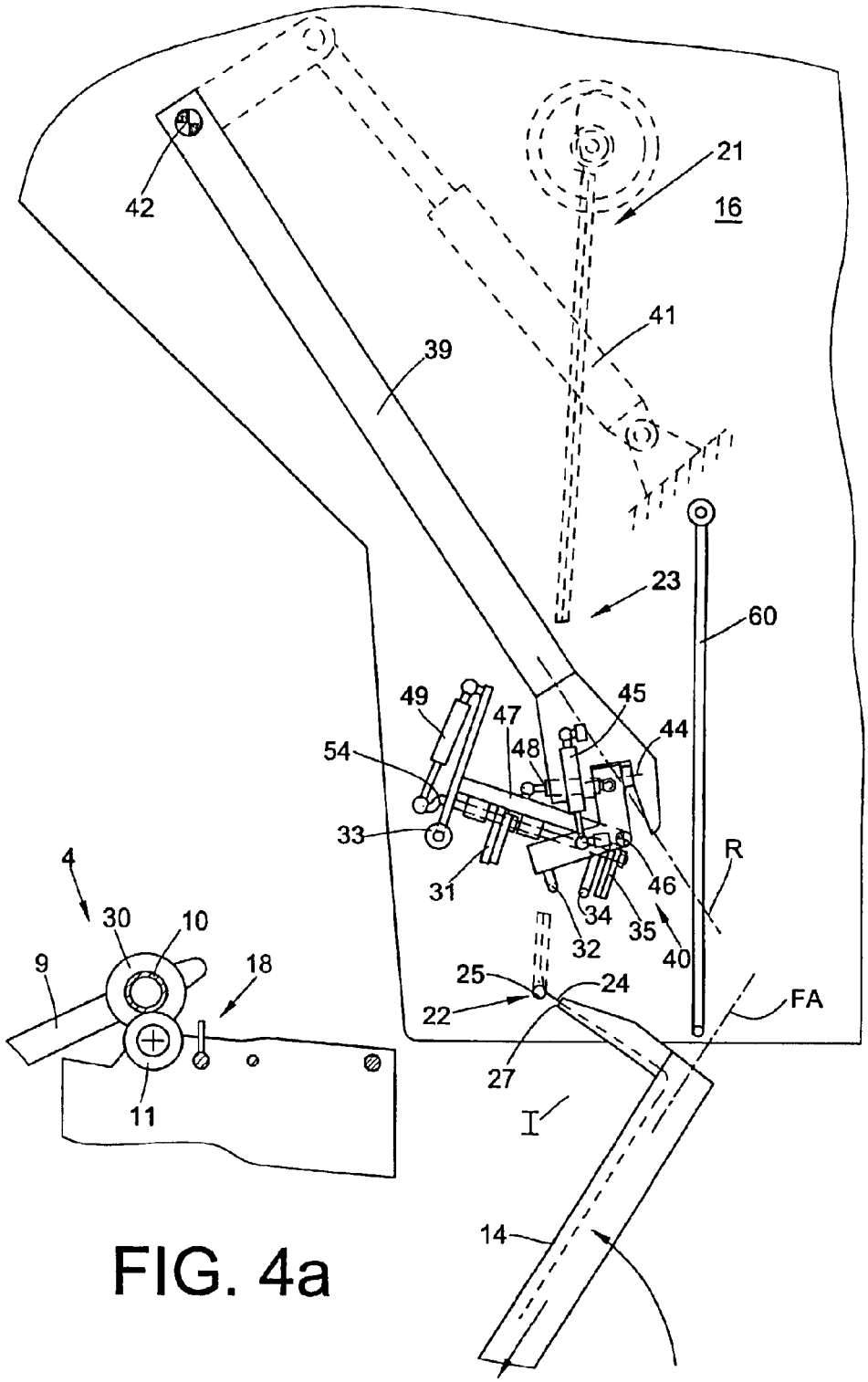
FIG. 4*a* another schematic elevational view of the service unit according to FIG. 1 with a stationary supply tube and loop puller.
Figure 4B:
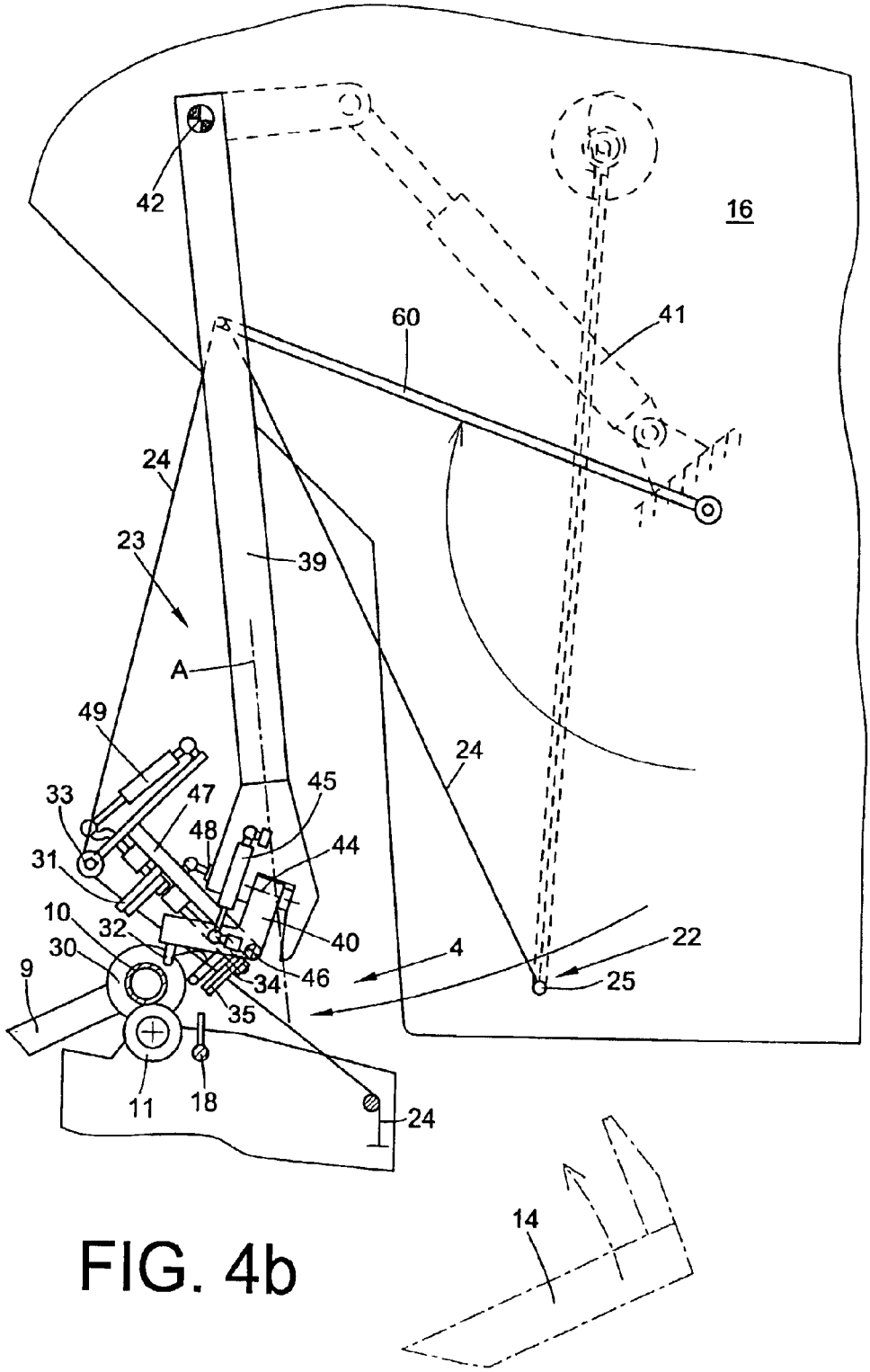
FIG. 4*b* is another schematic elevational view of the service unit according to FIG. 4*a* with the loop puller pivoted inwardly.

FIGS. 4*a*, 4*b* show a service unit 16 with stationary supply tube 22. Service unit 16 comprises in this instance additional loop puller 60 that can be pivoted out of the resting position shown in FIG. 4*a* into the operating position indicated in FIG. 4*b*.

Loop puller 60 entrains auxiliary yarn 24 extending between spinning start member 20 of the work station and mouth 25 of supply tube 22 in such a mannner that it can subsequently be grasped, ad is known, by yarn moving device 23 and moved into the area of winding device 4.

Yarn moving device 23 is comprised substantially of carrier arm 39 also supported in an intermediate wall of service unit 16. Carrier arm 39 comprises head element 40 on its end and is supported at its pivot shaft in such a manner that it can be rotated to a limited extent and also moved axially. The radial pivoting of carrier arm 39 between resting position R and work position A takes place via thrust piston transmission 41, while thrust piston transmission 43 is provided for the axial moving of carrier arm 39.

As is apparent from the drawings, head element 40 is connected via pivot shaft 44 to carrier arm 39 and can be pivoted to the side via thrust piston transmission 45. Tube plate opener 32 as well as spring-loaded yarn guidance device 34 are fastened to head element 40. Moreover, yarn piecing head 47 is movably articulated to head element 40 via pivot shaft 46 and carries various functional elements such as yarn cutting device 31, deflection roller 33 and yarn brake 35. Further, yarn joining head 47 can be pivoted by thrust piston transmission 48 and can be pivoted as required out of the position shown in FIG. 2*d* into the position shown in FIG. 2*e*.

In order to actuate yarn cutting device 31 and yarn brake 35, thrust piston transmission 49 is provided for controlling the previously cited functional elements via linkage 54. The actuation of spring-loaded yarn guidance device 34 arranged in the area of yarn brake 35 takes place automatically during the pivoting in of yarn joining head 47. Specifically, during the pivoting in of yarn joining head 47, spring-loaded yarn guidance device 34 is moved automatically via an appropriate stop into its work position.

Figure 7:
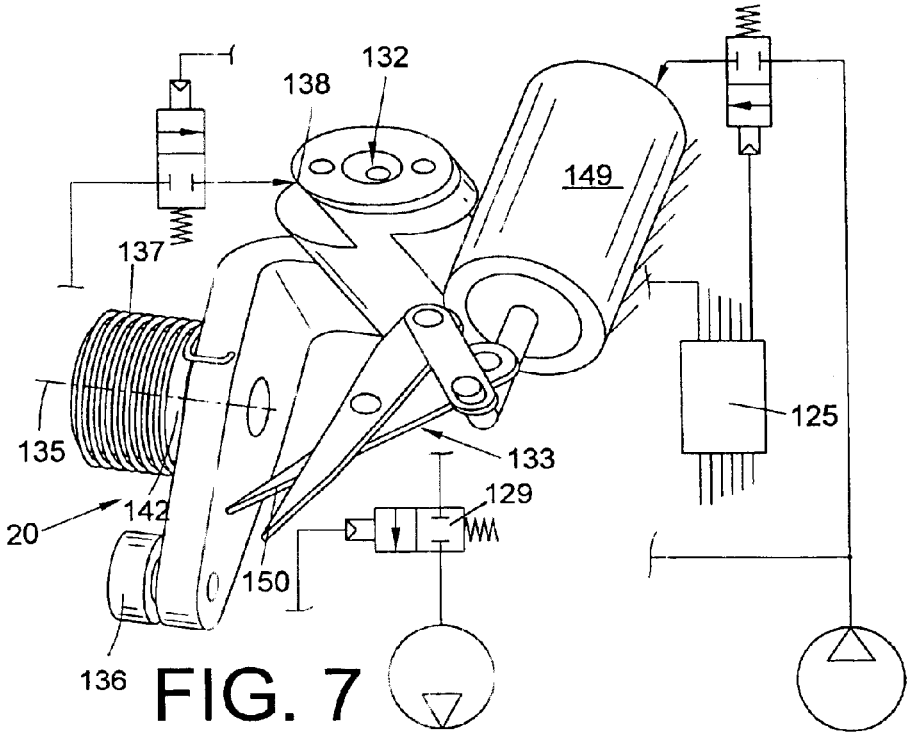
FIGS. 7 and 8 are perspective and sectional views of a spinning start member forming part of the work station.
Figure 8:
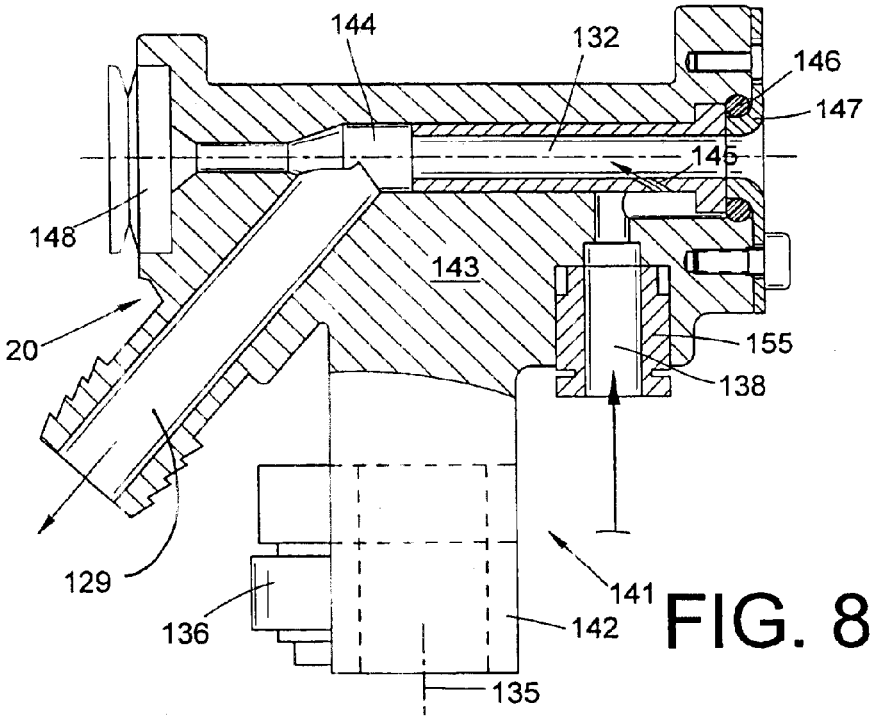

FIGS. 7, 8 show spinning start member 20 of the work station. Spinning start member 20 takes auxiliary yarn 24 moved by suction nozzle 14, prepares it and holds it available for the spinning restart process. Spinning start member 20 is comprised substantially of foundation 141, preferably produced in an injection molding or die-casting process and comprising, among other things, cylindrical shoulder 142 for receiving spring element 137. Pivot axis 135 of spinning start member 20 is also located in the area of this cylindrical shoulder 142. In addition, foundation 141 comprises a connecting bore on its end for fastening stop 136, whereas on the opposite side of foundation 141 a receiving housing 143 for yarn opening tube 132 is arranged. Receiving housing 143 for yarn opening tube 132 comprises stepped passage bore 144 to which a vacuum connection 129 and a compressed air connection 138 are connected. Moreover, a rapid coupling device 155 can be arranged in the area of compressed air connection 138. Yarn opening tube 132 is fixed in passage bore 144 and comprises, as is known, one or several tangential bores 145 through which a flow of compressed air can be applied on the end of auxiliary yarn 24 pneumatically fixed in yarn opening tube 132 and during which the yarn twist can be opened.

As is apparent from FIG. 8 in particular, yarn opening tube 132 is fixed via O-ring seal 146 or the like as well as boltable cover sheet 147 in passage bore 144. Seal 148 is provided on the opposite side of passage bore 144 bordering open-end spinning device 2. In addition spinning start member 20 comprises pneumatically actuable yarn cutting device 133. That is, scissors 150 or the like are connected to thrust piston transmission 149 that can be controlled in a defined manner via work station computer 125.

The operation of the device in accordance with the invention will thus be explained and understood with respect to the exemplary embodiment of FIGS. 2*a*–2*e* as follows.

Figure 2A:
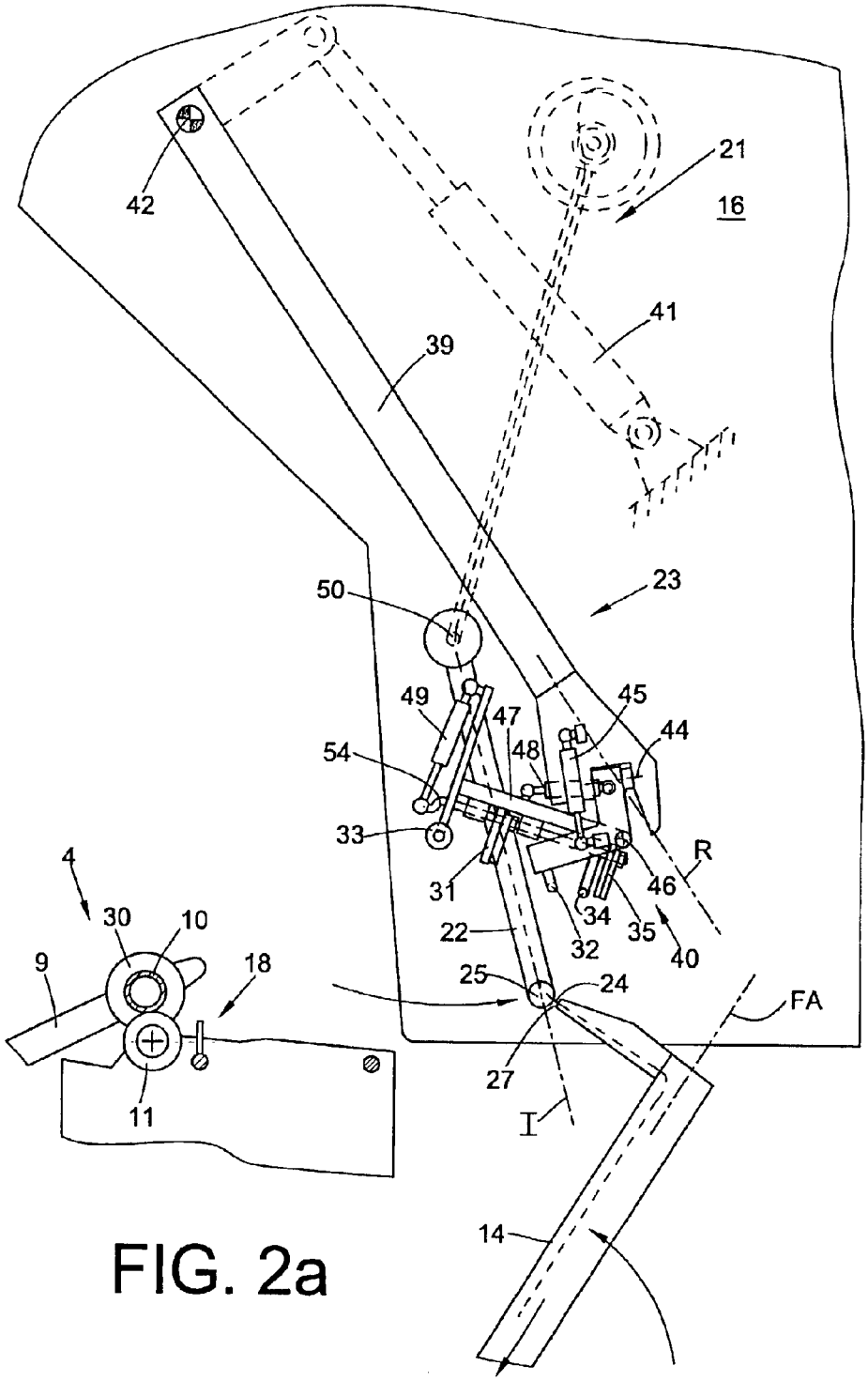
FIGS. 2*a*–2*e* are more detailed schematic elevational views of the service unit and the winding device of the work station of FIG. 1, showing the individual method steps that take place in the service unit when the supply tube of the auxiliary yarn supply device is rotatably supported.

When a cheese 8 has attained its set diameter at one of work stations 2, service unit 16 is ordered to the particular work station 2 concerned and replaces the full cheese 8 thereat automatically with a new empty tube 10. Specifically, after the ejection of the full cheese 8, a new empty tube 10 is placed at first between tube plates 30 of creel 9 of the particular work station 2 by appropriate (not shown) manipulating devices of service unit 16. This situation is schematically shown in FIG. 2*a*.

Then, in order to restart the spinning of work station 2, suction nozzle 14 forming part of the work station is pivoted into yarn take-up position FA. At the same time, supply tube 22 of service unit 16 is rotated by stepping motor 38 about pivot shaft 50 such that mouth 25 of supply tube 22 is positioned in front of suction intake opening 27 of suction nozzle 14. Thus, supply tube 22 assumes its operating position 1.

Supply tube 22 is connected to auxiliary yarn supply device 21, as explained above, and is now loaded pneumatically in such a manner that auxiliary yarn 24 exits out of mouth 25 of supply tube 22. Exiting auxiliary yarn 24 is immediately drawn by suction, as indicated in FIG. 2*a,* by vacuum-loaded suction nozzle 14 of work station 2.

Yarn moving device 23 is still positioned in its rest position R at this point in time, as indicated.

Figure 2B:
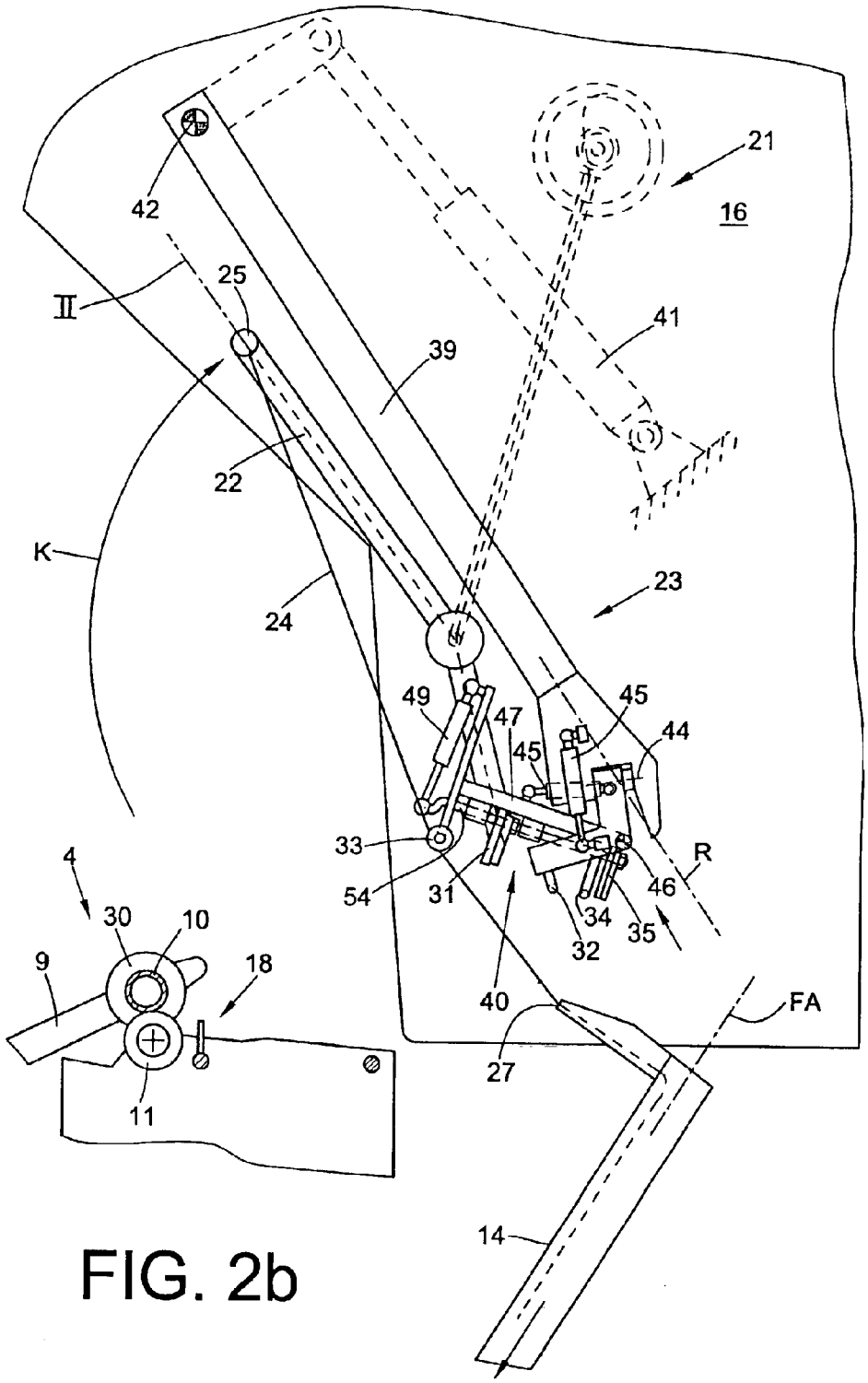

Supply tube 22 is subsequently pivoted into the second, upper operating position II (FIG. 2*b*). Auxiliary yarn 24 is subsequently appropriately supplied thereby by auxiliary yarn supply device 21. During the pivoting of supply tube 22 into operating position II, the auxiliary yarn is drawn over deflection roller 33 of yarn moving device 23, that is still positioned at this point in time in its rest position R.

Figure 2C:
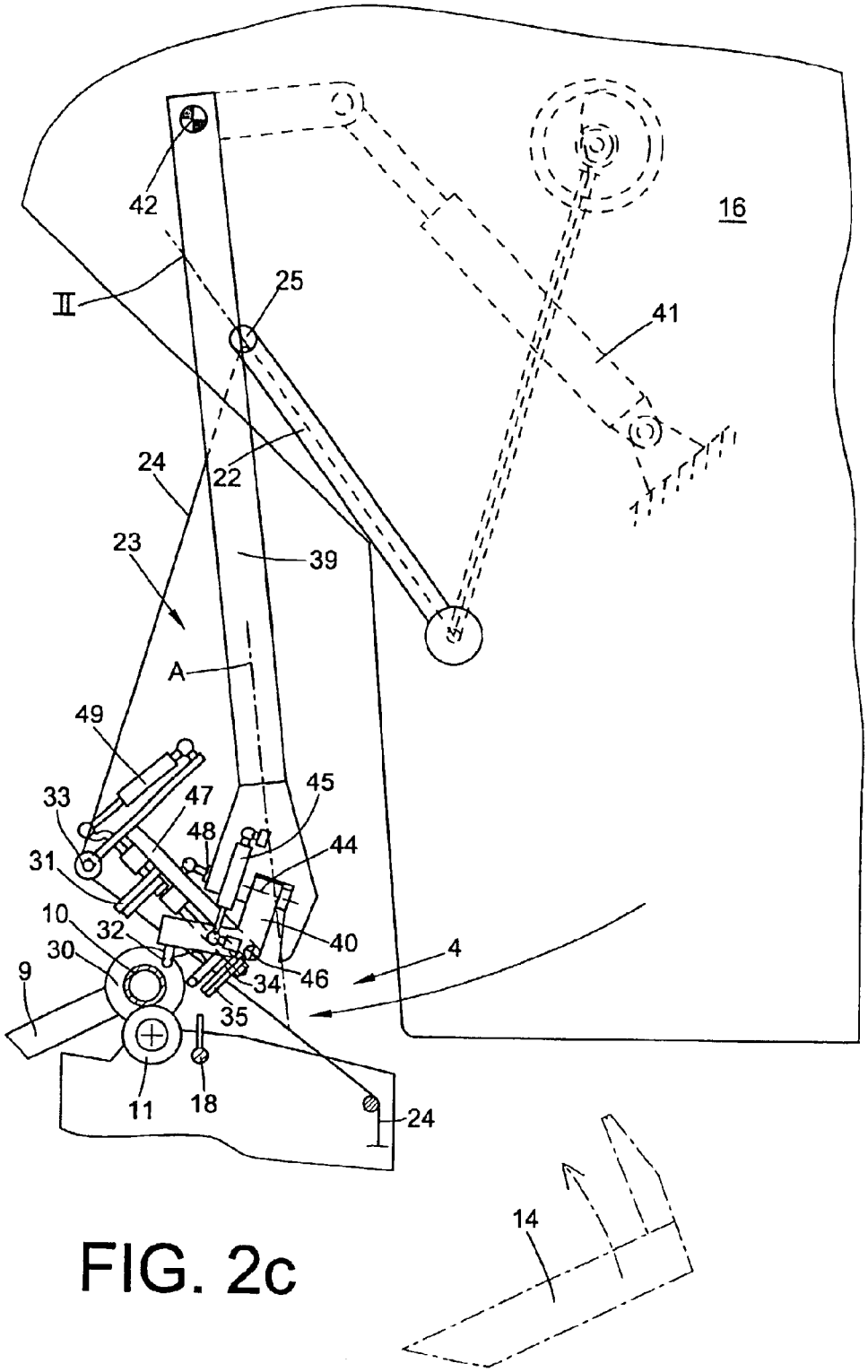

In the next step, thrust piston transmission 41 is controlled in such a manner that yarn moving device 23 is pivoted forward into its work position A. Auxiliary yarn 24 is threaded thereby into yarn cutting device 31 arranged on yarn moving device 23 as well as into yarn brake 35. At the same time, suction nozzle 14, that pneumatically fixes the starting end of auxiliary yarn 24, is pivoted downwardly into the position shown in dotted lines in FIG. 1 and transfers auxiliary yarn 24 to spinning start member 20 of work station 2. The end of auxiliary yarn 24 is prepared for the subsequent spinning start process and the auxiliary yarn is held available for the spinning start process in an appropriate yarn preparation device of spinning start member 20, preferably in a known, pneumatically loadable preparation tube. The suction nozzle, which is now free, pivots back upwardly, as is indicated in FIG. 2*c*.

Figure 2D:
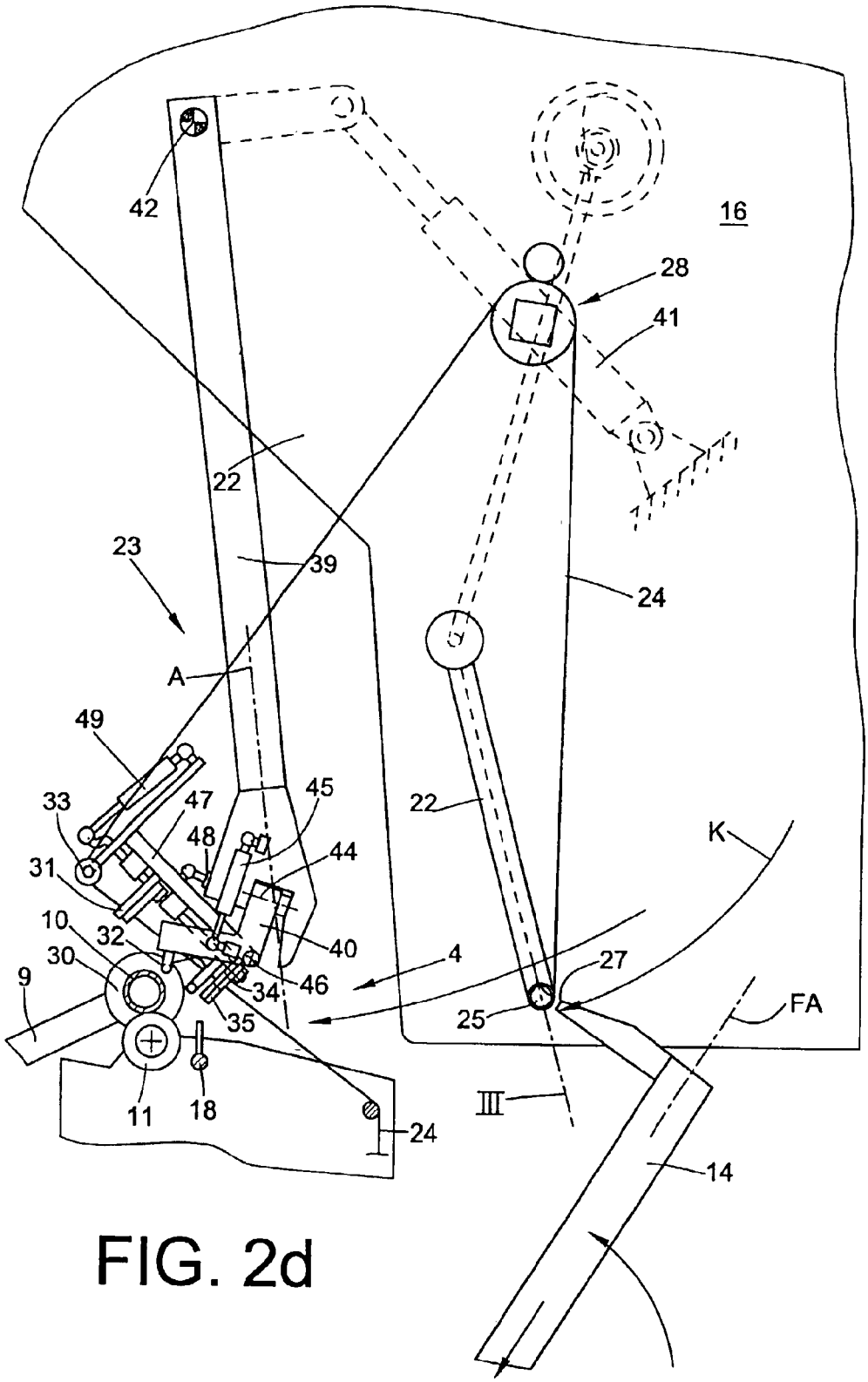

As FIG. 2*d* shows, supply tube 22 pivots further and re-attains operating position I. During the course of this pivoting movement of supply tube 22, auxiliary yarn 24 is placed into yarn draw-off device 28, which can either be designed as a mechanically operating roller supply mechanism, as in the exemplary embodiment, or operates pneumatically. In this instance, e.g., an injector supply device is provided.

In addition, during the pivoting movements of supply tube 22 into its operating positions, an appropriately coordinated length of auxiliary yarn is constantly re-supplied via a yarn supply mechanism arranged, e.g., at the input side of auxiliary yarn supply device 21.

While supply tube 22 is being pivoted back into its operating position I, suction nozzle 14, which has transferred auxiliary yarn 24 to spinning start member 20 of work station 2 and is also now free, is pivoted upward again and is again in its yarn take-up position FA.

Auxiliary yarn 24 is now separated by yarn cutting device arranged inside auxiliary yarn supply device 21 and exits on account of the prevailing blown air current out of mouth 25 of supply tube 22, during which it is immediately drawn into suction nozzle 14 on account of the vacuum present in the area of suction intake opening 27 of suction nozzle 14. Thus, auxiliary yarn 24 is now held between spinning start member 20 of work station 2 and between suction nozzle 14 of the work station and runs through yarn moving device 23, through yarn draw-off device 54 of work station 2 and through yarn draw-off device 28 of service unit 16.

Figure 2E:
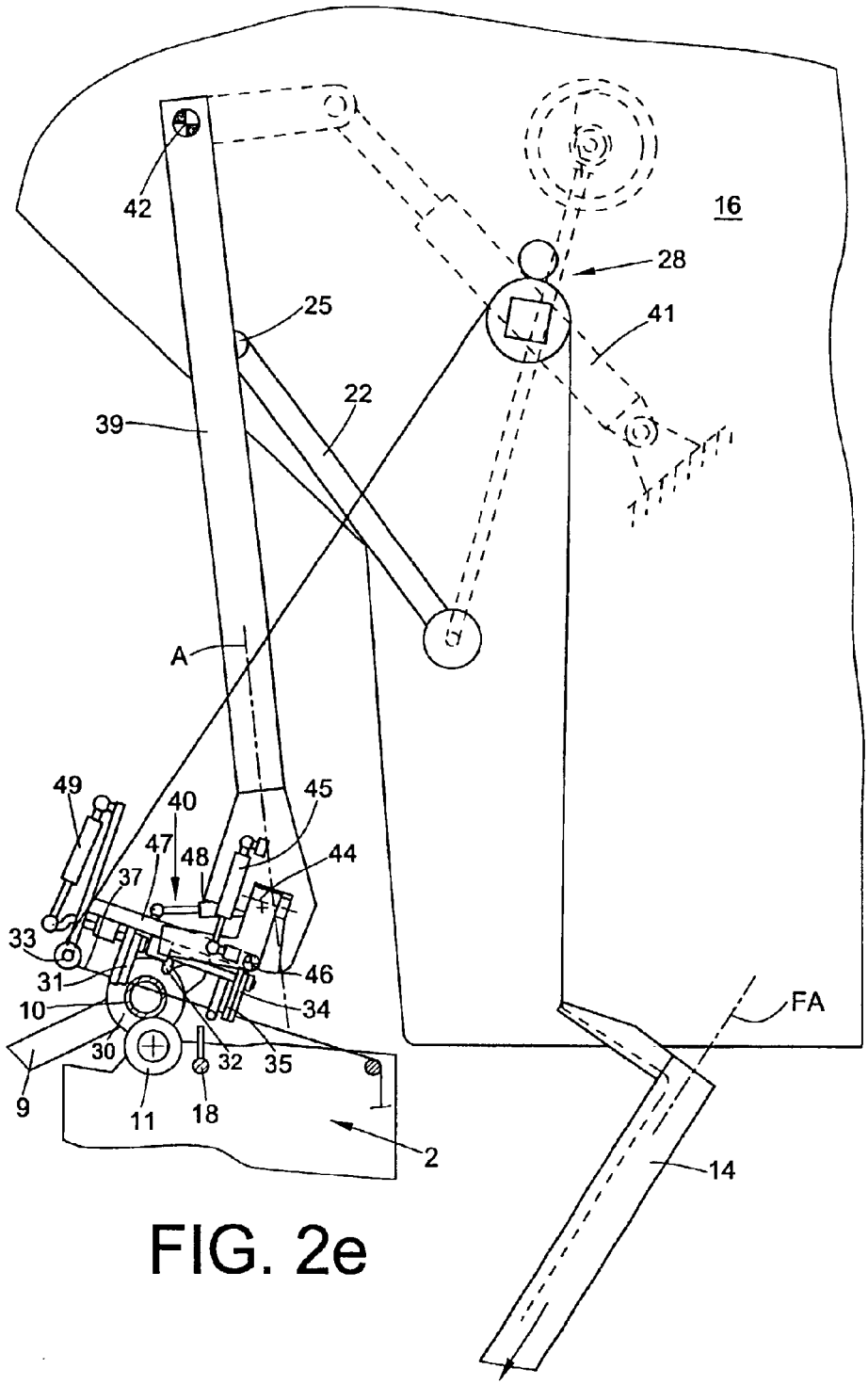

Yarn moving device 23 is subsequently loaded axially by thrust piston transmission 43. Yarn moving device 23 is thereby positioned with a stop element (not shown) on the housing of winding device 4 and tilts tube plate 30 somewhat outwardly with tube plate opener 32 resting on this tube plate 30 of creel 9. A wedge-shaped slot is produced thereby between tube plate 30 and the front side of tube foot 36 of empty tube 10 held in creel 9 into which slot a portion 37 of auxiliary yarn 24 is subsequently placed by a pivoting movement of yarn joining head 47. That is, yarn joining head 47 is pivoted forwardly about pivot shaft 46 by thrust piston transmission 48, as indicated in FIG. 2*e,* so that auxiliary yarn 24 forms a yarn portion 37 in front of the front side of tube foot 36. Yarn portion 37 extends, as apparent from FIG. 2*e,* through yarn cutting device 31 and yarn brake 35 and is secured by yarn guide device 34, which was actuated during the pivoting of yarn joining head 47.

In order to restart the spinning operation of spinning device 3, prepared yarn end of auxiliary yarn 24, which end is held available by spinning start member 20 of work station 2, is at first fed back briefly into spinning device 3 and a fiber ring circulating there is broken. The prepared end of auxiliary yarn 24 is thereby joined to new spinning yarn 7 forming a so-called spinning start yarn portion, and the auxiliary yarn and the pieced spinning start yarn portion are subsequently withdrawn off via yarn withdrawal device 54 (indicated in FIG. 1) of work station 2 as well as via approximately synchronously running yarn withdrawal device 28 of service unit 16 and immediately removed by suction nozzle 14 of work station 2. This removal runs until the pieced spinning start yarn portion passes a sensor device (not shown). When the spinning start yarn portion has run through, the actual placing of spinning yarn 7 on empty tube 10 as well as the winding of yarn reserve 26 onto empty tube 10 take place.

That is, a few rapid movements now take place immediately one after the other. During this time the yarn briefly stands still on tube plate 30. Since the spinning device is continuously producing spinning yarn 7 at the same time, this spinning yarn is briefly stored in an intermediate fashion in storage nozzle 55 of work station 2. The maximum storage length of the yarn is approximately 1 meter.

In particular, the following method steps result especially for the clamping of the new spinning yarn 7 between tube plate 30 and empty tube 20 as well as for the production of yarn reserve 26 on empty tube 10.

The new spinning yarn 7 is cut by yarn cutting device 31 just above empty tube 10 and at the same time clamped by yarn brake 35 positioned below empty tube 10. The cut yarn piece still running via yarn withdrawal device 28 is removed via suction nozzle 14.

Immediately after the yarn separation, tube plate 30 is closed by pivoting head element 40 back about pivot shaft 44 and spinning yarn 7 is reliably clamped between empty tube 10 and the front surface of tube foot 36.

Yarn cutting device 31 and yarn brake 35 are then opened by appropriately controlling thrust piston transmission 49. Spinning yarn 7 is positioned in front of the so-called yarn reserve groove of empty tube 10. Winding drum 11 is subsequently started and accelerates empty tube 10 resting thereon via friction to winding speed. After a certain number of tube rotations, e.g., three rotations, yarn brake 35 is closed. Thus, the remaining windings of yarn reserve 26 are wound with an elevated yarn tension and offset a few millimeters to the outside so that the yarn start is overwound and is thus reliably fixed.

After the completion of yarn reserve winding 26, spinning yarn 7 is released by pivoting yarn moving device 23 backwardly and can be taken up by yarn traversing device 18 of work station 2.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for restarting a spinning operation in work stations of an open-end spinning machine after replacement of a yarn cheese with an empty cheese-winding tube, wherein the spinning machine comprises multiple work stations, each work station having a spinning device for producing a yarn and a winding device with a creel for winding the yarn into a cheese, and an automatically operating service unit comprising an auxiliary yarn supply device for attending the plural work stations, the method comprising, at a work station requiring restarting of the spinning operation, transferring a starting portion of an auxiliary yarn from the auxiliary yarn supply device of the service unit to a suction nozzle of the work station, transferring the auxiliary yarn via the suction nozzle to a spinning start member of the work station, moving the suction nozzle again to the auxiliary yarn, re-grasping via the suction nozzle the auxiliary yarn extending between the auxiliary yarn supply device and the spinning start member, removing via the suction nozzle the auxiliary yarn after the auxiliary yarn has been used in the spinning device of the work station for restarting the spinning operation, and moving the yarn produced in the spinning device to the creel of the work station to resume winding thereof.

2. The method according to claim 1, wherein a supply tube of the auxiliary yarn supply for transferring the starting portion of the auxiliary yarn to the suction nozzle is first positioned in a first operating position, the supply tube is then moved into a second operating position wherein the auxiliary yarn extending between the suction nozzle and the supply tube is moved into the area of the creel, and the supply tube is subsequently returned to the first operating position wherein the auxiliary yarn is again transferred to the suction nozzle in a ready condition for a subsequent removal of the auxiliary yarn.

3. The method according to claim 1, wherein a supply tube of the auxiliary yarn supply device for transferring a starting portion of the auxiliary yarn to the suction nozzle is first positioned in a first operating position, the suction nozzle transfers the auxiliary yarn to a spinning start member forming part of the work station, the suction nozzle again takes the auxiliary yarn from the supply tube positioned in the operating position, and the supply tube is then moved into a second operating position and the auxiliary yarn extending between the suction nozzle and the supply tube is moved into the area of the creel.

4. The method according to claim 1, wherein a new portion of the yarn produced in following connection with the auxiliary yarn after the re-start of the spinning operation is brought into the area of the creel and fixed in a defined manner to an empty cheese-winding tube rotatably mounted in the creel.

5. The method according to claim 1, wherein the auxiliary yarn supply device comprises a stationary supply tube, and the suction nozzle is moved to the stationary supply tube twice at a spaced interval for taking the auxiliary yarn, wherein a yarn loop is formed between the first and the second taking of the auxiliary yarn for enabling the auxiliary yarn to be moved into the area of the creel.

6. The method according to claim 2, wherein, after the supply tube is repositioned in the operating position and the suction nozzle for taking the auxiliary yarn has moved into a yarn take-up position, the auxiliary yarn is separated by a yarn cutting device arranged inside the auxiliary yarn supply device for transferring the auxiliary yarn to the suction nozzle.

7. The method according to claim 1, wherein the auxiliary yarn moved from the suction nozzle to the spinning start member of the work station is prepared in the spinning start member and held available for a subsequent spinning start process.

8. The method according to claim 1, wherein the auxiliary yarn and a spinning start yarn portion piecing the auxiliary yarn with the yarn are removed by the suction nozzle after the re-start of the spinning operation.

9. An open-end spinning machine with plural work stations, each work station comprising a spinning device for manufacturing a yarn, a winding device with a creel for producing a cheese, a suction nozzle, and a spinning start member, and an automatically operating service unit comprising an auxiliary yarn supply device for attending the plural work stations with an auxiliary yarn for re-starting the spinning operation after replacement of a yarn cheese with an empty cheese-winding tube, wherein the auxiliary yarn supply device comprises a supply tube arranged such that the suction nozzle forming part of the work station can successively grasp a starting portion of the auxiliary yarn, transfer the starting portion of the auxiliary yarn to the spinning start member, re-grasp the auxiliary yarn thereafter extending between the supply tube and the spinning start member after a separation of the auxiliary yarn in the auxiliary yarn supply device and remove the auxiliary yarn after a restart of the spinning operation, and a yarn moving device for transferring the yarn produced in the spinning device to an empty cheese-winding tube rotatably mounted in the creel.

10. The open-end spinning machine according to claim 9, wherein the supply tube comprises a drive for positioning the mouth of the supply tube in a first operating position wherein the auxiliary yarn is transferred to the suction nozzle and a second operating position wherein the auxiliary yarn is moved to the winding device.

11. The open-end spinning machine according to claim 10, wherein the supply tube comprises a drive for pivoting the mouth of the supply tube along an arcuate path for defined positioning of the supply tube in the first and second operating positions.

12. The open-end spinning machine according to claim 11, wherein the supply tube comprises a drive for linear movement of the supply tube for defined positioning thereof in the first and second operating positions.

13. The open-end spinning machine according to claim 9, wherein the supply tube is arranged stationarily, and further comprising a device for positioning the auxiliary yarn for transfer into the area of the winding device.

14. The open-end spinning machine according to claim 9, further comprising a yarn moving device for moving the yarn to the winding device and for clamping of the yarn between an empty cheese-winding tube held in the creel and a tube plate.

* * * * *